US005448802A

United States Patent [19]

Pirnes et al.

[11] Patent Number: 5,448,802

[45] Date of Patent: Sep. 12, 1995

[54] APPARATUS FOR THE PRODUCTION OF A FOLDED NON-WOVEN FABRIC

[75] Inventors: Timo Pirnes, Turku; Jouko Kuusijärvi, Piispanristi, both of Finland

[73] Assignee: MC-Konerakennus Oy, Turku, Finland

[21] Appl. No.: 157,123

[22] PCT Filed: Jun. 3, 1992

[86] PCT No.: PCT/FI92/00175

§ 371 Date: Apr. 7, 1994

§ 102(e) Date: Apr. 7, 1994

[87] PCT Pub. No.: WO92/21807

PCT Pub. Date: Dec. 10, 1992

[30] Foreign Application Priority Data

Jun. 6, 1991 [FI] Finland ..... 912736

[51] Int. Cl.[6] ..... D04H 1/70

[52] U.S. Cl. ..... 19/163; 28/101

[58] Field of Search ..... 19/163; 28/100, 101

[56] References Cited

U.S. PATENT DOCUMENTS

| | | | |
|---|---|---|---|
| 772,832 | 10/1904 | Schofield et al. . | |
| 1,758,517 | 5/1930 | Hess | 19/163 |
| 3,903,569 | 9/1975 | Brandis | 19/163 |
| 4,628,571 | 12/1986 | Marx et al. | 19/163 X |

FOREIGN PATENT DOCUMENTS

| | | | |
|---|---|---|---|
| 12202306 | 8/1973 | Germany . | |
| 618668 | 3/1961 | Italy | 19/163 |
| 65403 | 2/1950 | Netherlands | 19/163 |
| 1486 | 3/1883 | United Kingdom | 19/163 |

*Primary Examiner*—John J. Calvers

*Attorney, Agent, or Firm*—Ladas & Parry

[57] ABSTRACT

An apparatus for the production of a folded non-woven fabric includes a card for making a fiber web of non-woven fabric and a folder for folding the fiber web. To reduce the need of space required for the apparatus, the folder has a transfer table, on which the card is positioned in a way to allow a back and forth movement, a mechanism for moving the card back and forth supported on the transfer table and a feed device allowing a change of distance and position between the card and the fiber feed.

7 Claims, 1 Drawing Sheet

APPARATUS FOR THE PRODUCTION OF A FOLDED NON-WOVEN FABRIC

FIELD OF THE INVENTION

The present invention relates to an apparatus for the production of a folded non-woven fabric, comprising means including a card for making a fibre web of the non-woven fabric and a folder for folding the fibre web.

BACKGROUND

In connection with this application, a fibre web of a non-woven fabric means a fibre web manufactured of some fibre, such as cotton, glass or stone wool fibre or some other fibre by means of a card. At the manufacture of a synthetic non-woven fabric, for example, the purpose of folding is to fold a desired number of web layers on each other to form a fabric of a desired thickness to be used in waddings of different textiles, for instance.

At conventional manufacture of non-woven fabrics, raw material is brought as bales to an opener, which breaks up the bales, after which the fibres are led to a licker-in dispersing the fibres to a mass as even as possible. After this the fibres are typically led to a feed box and from there to a card. These structures relating to the production of a non-woven fabric are stationary, and the fibre web is not brought until finished by means of belt or roller conveyors to a separate folding device, which can be of pendulum or sled type. Thus, to provide the folding, both a separate folder and separate means to transfer the fibre web to the folder are required, and on the other hand, the folder shall be the bigger, the longer is the folding breadth desired. In general, it can be stated that the folder increases the total costs of the apparatus and the need of space substantially.

SUMMARY OF THE INVENTION

The object of the present invention is to set forth a new type of apparatus for the production of a folded non-woven fabric, in which the number of necessary structural elements has been successfully reduced, and thus, both the costs and the need of space of the apparatus have been substantially reduced. This object is achieved by means of an apparatus of the invention, which is characterized in that the folder comprises a transfer table, on which the card is positioned in a way allowing a back and forth movement, a mechanism for moving the card back and forth supported on the transfer table and a feed means allowing a change of distance and positioned between the card and the means providing the card with fibres.

The transfer mechanism of the card preferably comprises an endless transmission means, such as a belt, a chain or the like, arranged to run around two return wheels positioned at opposite ends of the transfer table, at least one of which wheels is driven. Moreover, it is preferable that the transfer mechanism of the card comprises means for adjusting the transfer rate of the card to agree with the web formation rate and for effecting a reversal of the card according to the folding breadth desired.

By means of the structural solutions described above, it is possible to replace a conventional folder by the transfer table of the card, whereby the total need of space is substantially reduced and conveying belts or drums, as well as pendulums and sleds, are omitted, which also reduces the production costs of the apparatus substantially. In addition, the number of the parts to be maintained, obtained in this manner, has become clearly smaller than previously, and therefore, the maintenance costs are also reduced. The bigger folding breadth is desired, the greater will the advantage of the apparatus of the invention be compared with a conventional separate folder. The back and forth movement of the card can be provided by controlling a motor driving the transmission means. In order to be able to substantially reduce the demands on this motor drive, a preferable embodiment of the apparatus of the invention is further characterized in that the means for effecting a reversal of the card and for adjusting the folding breadth comprise a switching means for the connection of the card alternatively to a portion of the endless transmission means moving in either direction and for the disconnection therefrom and spring means preferably with displaceable position within the area of both ends of the transfer table to absorb the kinetic energy of the card and to provide the card with a movement in opposite direction, when the switching means are disconnected. In this manner, the transmission means can be used, if desired, even at a uniform rate in one direction and a reversal of the card causes only a slight increase in load for the motor drive driving this transmission means.

BRIEF DESCRIPTION OF THE DRAWING

In the following, the apparatus of the invention is described in greater detail referring to an enclosed drawing, the sole Figure of which shows schematically one embodiment of the apparatus according to the invention by way of example.

DETAILED DESCRIPTION

Figure 1:
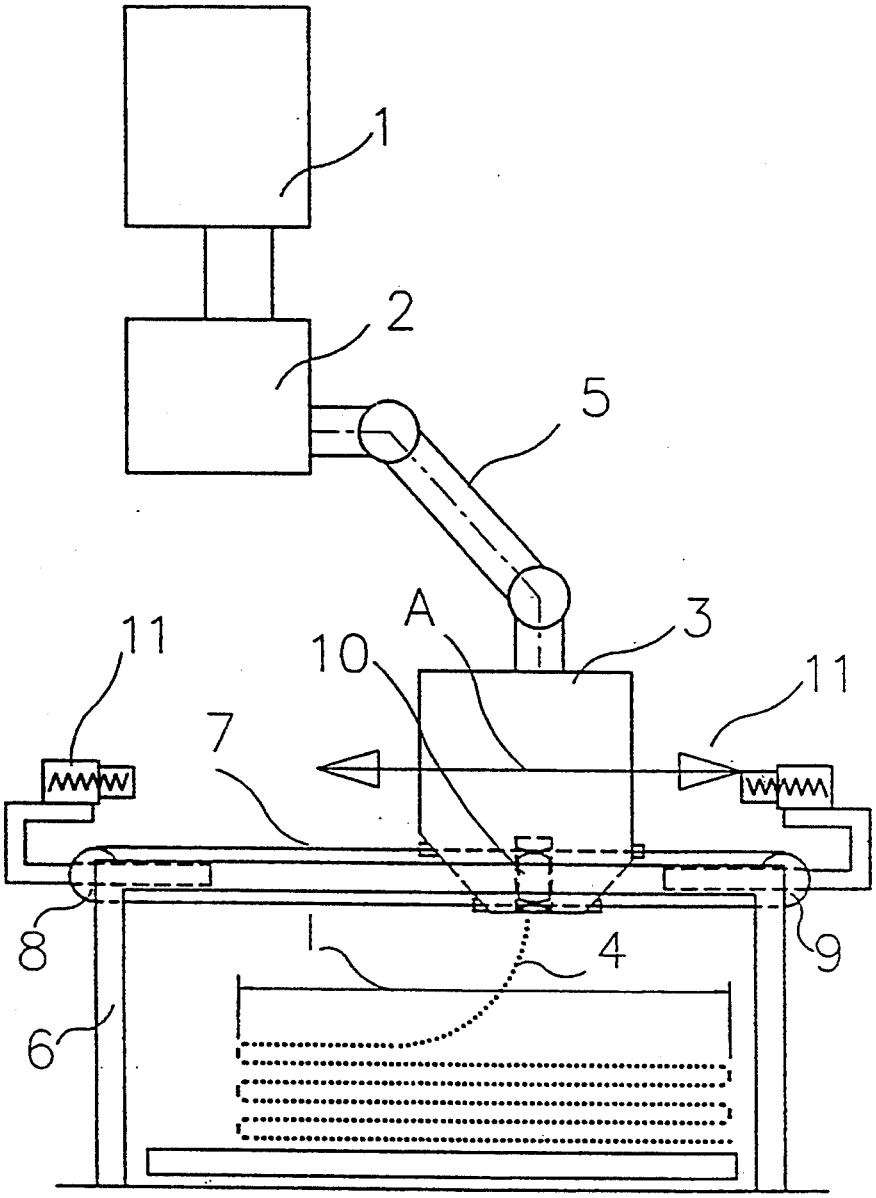

Means included in the apparatus of FIG. 1 for the production of a non-woven fabric 4 comprises an opener 1, a licker-in 2 and a card 3. No typical feed box is positioned between the licker-in 2 and the card 3, but the licker-in and the card 3 are connected with each other directly by means of a feed means, such as a feed tube 5, allowing a change of distance. This feed tube can either be articulated or formed of a corrugated tube, i.e. of a so-called "throat" tube, whereby it is capable of bending, thus allowing a movement of the card with respect to the licker-in 2. The omission of the feed box is based on the fact that the operating rates of the licker-in and the card are adjusted in such a way that no feed box serving as an intermediate depot is needed. Because the feed tube 5 is relatively long, it can also be considered to function as a feed box of some kind.

On the other hand, the means for folding the fibre web to the non-woven fabric 4 comprise a transfer table 6, on which the card 3 is supported. The simpliest manner to provide this support is to use suitable wheels or bearings. The transfer table 6 further comprises means for moving the card 3 on this transfer table back and forth in the direction of the arrow A. The simplest form of these means can comprise an endless transmission means, such as a belt, a chain or the like 7, arranged to run around two return wheels 8 and 9 positioned at the opposite ends of the transfer table 6. By connecting a motor drive (not shown) at least to either return wheel 8 or 9, the card 3 can be moved supported on the transfer table 6. For this purpose, the card 3 shall naturally comprise a means, by which it is connected to the transmission means 7. If the back and forth movement of the card 3 is effected by means of the motor drive of the transmission means 7, the card 3 can be permanently connected to the transmission means 7. However, the motor drive must then be relatively strong, because the back and forth movement of the relatively heavy card 3 supported on the transfer table 6 must be effected by means of that drive. This means that the movement of the card 3 includes quite frequent stops and accelerations in opposite directions.

The embodiment of the Figure shows a more preferable way of effecting a back and forth movement of the card 3. These means comprise firstly a switch 10 connected to the card 3, by means of which switch the card can be connected to either portion (upper or lower run) of a loop formed by the endless transmission means 7, according to which direction the card 3 is required to be moved. The means further comprises reversing springs 11 positioned to be supported on the transfer table 6 within the area of the opposite ends thereof and to be transferred along the table to provide the desired folding breadth 1.

In practice, the back and forth movement of the card is realized by means of these means in such a way that the card is at first moved in one direction with the switch 10 connected to the portion of the endless transmission means 7 moving in that direction and this switch is disconnected just before the desired folding breadth, whereby the card 3 continues its movement freely and hits the reversing spring 11, which absorbs the kinetic energy of the card 3 and makes it bounce in the opposite direction at almost the same rate at which the card 3 hit this reversing spring 11. After this the switch 10 is controlled to grip the portion of the endless transmission means 7 advancing in that very direction, whereby the card 3 continues its movement driven by this transmission means 7. Because rather little energy is lost at a reversal, it is hardly necessary to accelerate the card 3 after the reversal, and therefore, the motor drive of the transmission means 7 does not need to be strained substantially either in connection with this reversal. Due to this, the motor drive of the transmission means 7 can be a rather simple apparatus, which does not contain any automatic reversing mechanism, but a considerably lower effect is now especially required thereof than in a case in which the whole reversal would be effected by means of this motor drive. It is, however, preferable that the motor drive comprises a device for automatic rate adjustment, whereby the rate of movement of the card 3 can be adjusted to the web formation rate of the nonwoven fabric 4. By moving the reversing springs 11 on the transfer table 6, and of course, by controlling the switching means 10, respectively, the folding length 1 of the fibre web of non-woven fabric 4 can be adjusted as desired.

The apparatus for the production of a folded non-woven fabric according to the invention has been described by means of some exemplifying embodiments only and it is understandable that several changes can be made therein without deviating from the scope of protection defined by the enclosed claims, however. The most substantial aspect of the invention is that the previous typical card with fixed position is now arranged to move back and forth supported on a transfer table and thus to provide per se a folding of the fibre web manufactured.

What is claimed is:

1. Apparatus for the production of a folded non-woven fabric comprising:

means for producing a fabric web of non-woven fabric including an opener for receiving fibres, a licker-in for dispensing the fibers, a feed tube to receive the fibres from said licker-in and convey the fibers onwards, and a card to receive the fibres from the feed tube to produce a fibre web, and a folder on which the fibre web is folded, said folder including:

a stationary folding table, said card being supported on said folding table for back and forth displacement to deposit the fibre web in folds on the table, and a mechanism mounted on the table for moving the card back and forth, said feed tube being constructed and arranged to undergo change in length between the licker-in and the card during said back and forth movement of said card on said folding table.

2. Apparatus as claimed in claim 1, wherein said feed tube is corrugated.

3. Apparatus as claimed in claim 1, wherein said feed tube is connected between the licker-in and the card to undergo change in direction as well as change in length.

4. Apparatus as claimed in claim 1, wherein said mechanism for moving the card back and forth comprises an endless transmission including return wheels around which the transmission travels and drive means for at least one of said return wheels.

5. Apparatus as claimed in claim 4, wherein said mechanism moves the card back and forth on the table between positions which determine a length of the folds on the table, and further comprising means for adjusting said end positions and thereby the length of said folds.

6. Apparatus as claimed in claim 5, wherein said endless transmission includes first and second runs moving in opposite directions and switching means for respectively and alternatively connecting said card to said runs.

7. Apparatus as claimed in claim 6, comprising spring means at each of said end positions to absorb kinetic energy of said card and provide said card with movement in an opposite direction when the switching means provides alternate connection of the card with the runs.

* * * * *